US006854131B1

(12) United States Patent
Spongberg

(10) Patent No.: US 6,854,131 B1
(45) Date of Patent: Feb. 15, 2005

(54) ILLUMINATION AND HALLOWEEN COSTUME

(75) Inventor: Rod Spongberg, New York, NY (US)

(73) Assignee: Chosun International Inc., New York, NY (US)

( * ) Notice: Subject to any disclaimer, the term of this patent is extended or adjusted under 35 U.S.C. 154(b) by 0 days.

(21) Appl. No.: 10/214,847

(22) Filed: Aug. 8, 2002

Related U.S. Application Data

(60) Provisional application No. 60/311,678, filed on Aug. 10, 2001.

(51) Int. Cl.[7] ..... A41D 27/08

(52) U.S. Cl. ..... 2/69; 2/244

(58) Field of Search ..... 2/206, 69, 79, 2/108, 115, 227, 244, 246; 446/485, 26, 28; 362/154, 156, 34, 124, 185, 186, 189, 199, 806; 206/457; 428/7, 11

(56) References Cited

U.S. PATENT DOCUMENTS

| | | | | | |
|---|---|---|---|---|---|
| 2,428,133 | A | * | 9/1947 | Yogan | 40/540 |
| D158,915 | S | * | 6/1950 | Voss | D2/741 |
| 2,647,222 | A | * | 7/1953 | Nieset | 315/228 |
| 2,694,772 | A | * | 11/1954 | Gelardin | 362/189 |
| 2,932,917 | A | * | 4/1960 | Patane | 446/392 |
| 2,933,853 | A | * | 4/1960 | Laval, Jr. | 446/219 |
| 3,226,880 | A | * | 1/1966 | Novello | 446/325 |
| 3,258,589 | A | * | 6/1966 | Doring | 362/186 |
| 3,382,504 | A | * | 5/1968 | Barbosa | 2/80 |
| 3,805,050 | A | * | 4/1974 | Spiegel | 362/124 |
| 4,154,183 | A | * | 5/1979 | Nunez | 2/302 |
| 4,234,907 | A | | 11/1980 | Daniel | |
| D283,172 | S | * | 4/1986 | Johnson | D2/741 |
| D287,058 | S | * | 12/1986 | Silverman | D26/47 |
| 4,698,732 | A | * | 10/1987 | Hickey | 362/154 |
| 4,714,985 | A | * | 12/1987 | Hickey | 362/154 |
| 4,722,098 | A | * | 2/1988 | Stapleton | 2/69 |
| 4,802,071 | A | * | 1/1989 | Schuster | 362/154 |
| 4,926,296 | A | * | 5/1990 | Blume et al. | 362/156 |
| D311,594 | S | * | 10/1990 | Medina | D26/47 |
| 4,999,753 | A | | 3/1991 | MacKenzie | |
| 5,097,399 | A | * | 3/1992 | Gammache | 362/197 |
| 5,149,190 | A | | 9/1992 | MacKenzie | |
| 5,165,781 | A | * | 11/1992 | Orak | 362/186 |
| 5,385,500 | A | * | 1/1995 | Schmidt | 446/73 |
| D360,482 | S | * | 7/1995 | Freund | D26/47 |
| 5,434,761 | A | * | 7/1995 | Lesnick et al. | 362/189 |
| 5,546,604 | A | * | 8/1996 | Geller | 2/202 |
| 5,588,734 | A | | 12/1996 | Talamo et al. | |
| 5,597,230 | A | * | 1/1997 | Newman | 362/154 |
| 5,649,755 | A | | 7/1997 | Rapisarda | |
| 5,733,170 | A | * | 3/1998 | Wotton | 446/385 |
| 5,742,939 | A | | 4/1998 | Williams | |

(List continued on next page.)

OTHER PUBLICATIONS

Simplicity Pattern Co, Inc., Simplicity, Oct. 1992, pp. 368, 366, 379 and 359.*

*Primary Examiner*—John J. Calvert
*Assistant Examiner*—Alissa L. Hoey
(74) *Attorney, Agent, or Firm*—Kirkpatrick & Lockhart Nichols & Graham; Anthony H. Handal

(57) ABSTRACT

A costume promoting safety in an attractive manner is disclosed. The inventive costume comprises a flexible member having an appearance which creates, in the mind of an individual viewing the flexible member, an image of a person, animal, character or thing. The flexible member comprises a garment-like member. The garment-like member comprises a shirt-like garment section and a pants-like garment section. Attachment structure is secured to the flexible member and configured to be attached to a person and to attach the flexible member to the person. A light emitting member having an appearance which creates, in the mind of an individual viewing the light emitting member, an associated image associated with the image of a person, animal, character or thing completes the inventive costume.

9 Claims, 3 Drawing Sheets

U.S. PATENT DOCUMENTS 5,829,862 A * 11/1998 Ferrell ..... 362/554
5,855,429 A * 1/1999 Webb et al. ..... 362/396
5,878,931 A 3/1999 Morphet
5,893,629 A 4/1999 Gubernick
5,918,964 A * 7/1999 Bou ..... 362/186
5,931,560 A * 8/1999 Hoffman ..... 362/124
5,984,754 A * 11/1999 Freelander ..... 446/73
6,012,820 A * 1/2000 Weber et al. ..... 362/19
6,041,436 A * 3/2000 Keen ..... 2/69
6,059,423 A * 5/2000 Knopick ..... 362/156
6,109,763 A * 8/2000 Ohta et al. ..... 362/205
6,173,450 B1 * 1/2001 Hari ..... 2/69
6,200,000 B1 * 3/2001 Burnidge ..... 362/155
6,224,234 B1 * 5/2001 Demmery ..... 362/156
6,357,049 B1 * 3/2002 Hoffman ..... 2/69
D456,920 S * 5/2002 Hill ..... D26/38
6,428,178 B1 * 8/2002 Rubin ..... 362/103

* cited by examiner

ILLUMINATION AND HALLOWEEN COSTUME

CROSS REFERENCE TO RELATED APPLICATIONS

This application claims the benefit of U.S. provisional patent application No. 60/311,678 filed Aug. 10, 2001, the entire disclosure of which is hereby incorporated herein by reference thereto, as though fully set forth herein.

REFERENCE TO GOVERNMENT FUNDING

Not Applicable.

TECHNICAL FIELD

The present invention relates to costumes and autonomous lights and, in particular, costumes of the type worn by children at night on Halloween and has as its objective promoting visibility and user directed illumination in an attractive manner while preserving cost efficiency.

BACKGROUND OF THE INVENTION

The shortened days of late fall are near their shortest by the time All Hallows Eve or "Halloween" comes around. Nevertheless, it is during this time that almost the entire population of children in the United States is put at risk on a single evening by reason of the ritual of "trick or treating" during the eve of All Hallows. On this evening, children wander from door-to-door, and house-to-house, dancing across streets and through streets at a time when there is a relatively large amount of traffic on account of such events and people driving back to their homes after working all day, and driving off to the grocery store to buy something for their evening meals. In addition, the poor lighting conditions increase the likelihood of a common accident, such as tripping and falling.

The high concentration of children on the road, during such a busy part of the day presents a higher likelihood that children will be struck by unwary drivers. Indeed, not only is traffic quite high during the early evening, but this time of day is after many people have put in a hard full day of work and are more prone than they might be at other times to speeding, not paying attention, or simply fatigued and not at their best in reacting to dangerous situations. Anything which would promote the likelihood of a child being seen before it is too late to avoid an accident would be of real value.

One way of avoiding accidents is simply to use clothing which is visible, such as clothing which is bright in color. For example, policemen often wear vests in fluorescent orange, or the like. People are encouraged not to wear black clothing at night, when they are walking the dog, taking a stroll or the like.

Evolving from homemade get-ups that reach back into our earliest history, commercially available Halloween costumes have been commonplace during the past half-century. The use of lights with children's Halloween costumes, as is proposed in accordance with the present invention, is believed to be a natural and reliably implemented solution to the problem of increasing the visibility of children on Halloween night. Nevertheless, it appears that the same is largely nonexistent in any form, despite the strong need for such a valuable system.

Clothing with light displaying members is, of course, well known and will improve the likelihood that a child will not be injured on Halloween night. Perhaps the most common expedient in this area is the use of retroreflecting materials, such as tape incorporating retroreflective beads. Retroreflection can also be promoted through the use of molded plastic members with flat interfaces and faceted backs, which promote total internal reflection of incoming light in a direction diametrically opposed to the direction of the incident light. The result is to produce a strong reflection in a direction aimed at the source of incident light. For example, if the light falling on a retroreflective device originated from the headlights of an automobile, light will be reflected in a column generally aimed at the source automobile headlight, and this will generally be broad enough to include a substantial amount of reflected light reflected toward the eyes of the driver.

However, being merely reflective, retroreflective members will not work where lights are not being used, as in the case of a negligent driver, or the driver of a vehicle such as a bicycle, or the like. Moreover, motorcycles may not be effective to illuminate retroreflective members on children, because of the relatively poor nature of their road illumination systems. Even cars may not do a good job in this area if headlights are out of alignment or burned-out.

In response to the inadequacies of reflective members, light-emitting systems have evolved. See, for example, U.S. Pat. No. 5,649,755 to Rapisarda, which discloses wearing apparel incorporating a flexible light-transmitting assembly comprising a clear flexible polymer tape with a plurality of tooth shaped protrusions which provide reflecting points of light. However, such tape is relatively cumbersome and unsightly from an aesthetic standpoint. While a tape can be made more aesthetically acceptable by using it in a symmetrical fashion, for example as a pair of stripes on the arms of a person's jacket, as illustrated in Rapisarda, the end result is far from pleasing and will have an adverse impact on a highly decorated article of clothing such as a Halloween costume. While it has been suggested that flashing electrical light sources including light-emitting diodes can be applied to children's Halloween costumes to significantly enhance safety on Halloween evening, at least one device proposed, a flashing box-like device illustrated in U.S. Pat. No. 5,149,190 of McKenzie, also fails to present a cost effective, aesthetic solution.

In addition, such lighting does substantially nothing to illuminate possible dangerous conditions on the road or sidewalk, such as stones, ruts and the like.

Over the years, parents have handed their children flashlights to carry with them when trick-or-treating. The children look at these flashlights and think it makes them look like geeks, try to hide them or lose them as soon as the opportunity arises.

SUMMARY OF THE INVENTION

The present invention relies upon the association in the public mind between various animals, persons, characters, things and the like with other animals, persons, characters, things and the like. For example, a cross is associated with religious figures, a skull is associated with a skeleton, and a bat wing is associated with a popular super-character.

The inventive costume comprises a flexible member having an appearance which creates, in the mind of an individual viewing the flexible member, an image of a person, animal, character or thing. The flexible member comprises a garment-like member. The garment-like member comprises a shirt-like garment section and a pants-like garment section. Attachment structure is secured to the flexible member and configured to be attached to a person and to attach the flexible member to the person. A light-emitting member having an appearance which creates, in the mind of an individual viewing the light-emitting member, an image associated with the image of a person, animal, character or thing completes the inventive costume.

The inventive costume, which may be viewed as a costume kit, contains a costume representative of a character or object recognizable by a consumer, and a flashlight configured, dimensioned and decorated in a manner which conveys information that the flashlight is associated with the costume.

In an alternative embodiment, the flashlight acts as a light source driving a plurality of light outputting members. These light outputting members are configured, dimensioned and decorated to complement the costume with which they are sold.

Additionally, in an alternative embodiment, a receptacle for receiving trick-or-treat candy and the like is also included with the costume. The trick-or-treat receptacle is configured, dimensioned and decorated to complement and accompany the costume and flashlight previously mentioned.

In yet another alternative embodiment, the flashlight is incorporated into the trick-or-treat receptacle for receiving the trick-or-treat candy. In this embodiment, the trick-or-treat receptacle/flashlight is configured, dimensioned and decorated to complement and accompany the costume with which it is sold.

In a further embodiment, the flashlight is tethered to the costume, making it nearly impossible to lose. In yet another embodiment, the trick-or-treat receptacle for receiving trick-or-treat candy, with the flashlight incorporated into it is tethered to the costume in such a way as to make it an integral part of the costume.

BRIEF DESCRIPTION OF THE DRAWINGS

The advantages, and the system and apparatus of the present invention will be understood from the following description taken together with the drawings, in which.

DETAILED DESCRIPTION OF THE INVENTION

Figure 1:
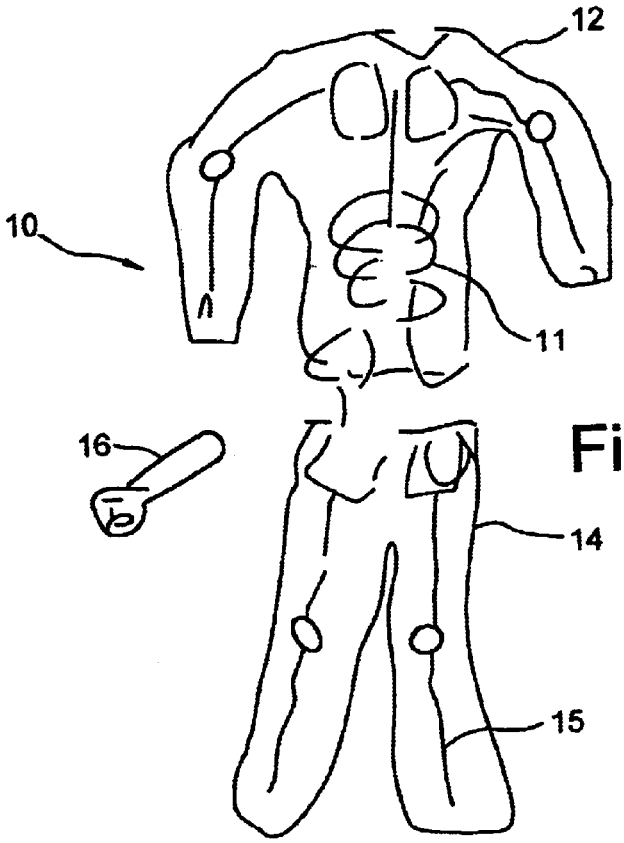
FIG. 1 is a perspective view of an embodiment of Halloween costume commonly worn by children.

Referring to FIG. 1, a Halloween costume 10 in accordance with the invention, to be worn by children for trick-or-treating is illustrated. A costume of this type commonly has a top portion 12 which is worn like a shirt, pulled over the user's head. Alternatively, the costume may be formed in a conventional way that allows the user to put his arms into the sleeves. Either buttons, snaps or zippers may be used to close the front or the back of the top portion 12. Additionally, a costume of this type commonly has a bottom portion 14 which can either be worn over pants or as a pants substitute. Bottom portion 14 may also contain pockets for the child to carry small items such as house keys.

FIG. 1 illustrates a costume 10 with a skeleton-like top image 11 printed or screened on top portion 12 and a bottom image 15 on bottom portion 14. As an alternative to an image, in accordance with the invention, the inventive costume may use sculptural features to achieve the costume effect, for example, an egg-shaped costume to achieve the look of Humpty Dumpty. Costumes can come in a variety of styles, with a look that represents an individual, character or object, whether fictitious or real, that is known to the consumer.

Figure 2:
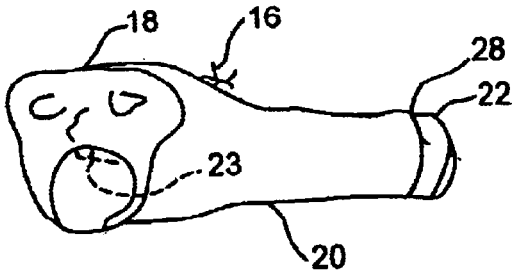
FIG. 2 is a perspective view of an embodiment of the present invention that is configured and dimensioned to be sold with the costume illustrated in FIG. 1.

Referring to FIG. 2, a flashlight 16 in accordance with the present invention is illustrated. Flashlight 16 may be a two penlight battery or single penlight battery flashlight so that it is easily associated with and secured to the costume as appears below. Any small battery may be used, preferably one smaller than a common penlight or AAA size battery. In addition, the flashlight may be made disposable.

Flashlight 16 comprises a decorative light-emitting member 18, a battery housing member 20, and an end cap 22. Decorative member 18 can be representative of a character, or an object commonly known to a consumer. In the present invention, decorative member 18 corresponds in some manner with the costume 10 as illustrated in FIG. 1. Light output of the flashlight is provided for by a common incandescent lamp 23 or other suitable source. In particular, FIG. 1 illustrates a skeleton-like costume, and corresponding flashlight decorative member 18 may be a skull as illustrated in FIG. 2, or alternatively may be a skull and crossbones, or in the shape of the bones of a hand, or the like.

End cap 22 is of the type commonly found on a flashlight such that batteries can be placed in at the end 28 of battery housing 20 and closed off with end cap 22. It is also noted that end cap 22 can contain a decorative element in such a manner that it complements the costume with which it was sold. For example, referring to the skeleton-like representation in FIG. 1, decorative element 18 may contain the appearance of the bones of the hand, battery housing member 20 may contain a representation of the bones of the wrist and forearm, and end cap 22 may contain a representation of the bones of an elbow. Alternatively, decorative member 18, battery housing member 20 and end cap 22 can form one single shape, such as the shape of one long bone, with decorative member 18 and end cap 22 representing the epiphysis and battery housing member 20 representing the diaphysis. End cap 22 is threadedly mounted on battery housing member 20 in a conventional manner.

It is also noted that batteries can be inserted through a separation between battery housing member 20 and a decorative member 18 threadedly mounted on battery housing member 20. In this alternative embodiment, end 28 may be permanently closed off to prevent loss of the batteries.

Figure 3:
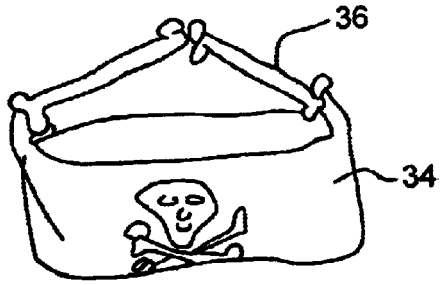
FIG. 3 is a side view of an embodiment of the present invention.

Additionally, as illustrated in FIG. 3, a trick-or-treat receptacle 34 for receiving trick-or-treat candy and the like can be included with costume 10 and flashlight 16. Trick-or-treat receptacle 34 includes a handle 36 for the user to hold onto and is configured with a representative feature and dimensioned to complement costume 10 and flashlight 16. For example, referring to the skeleton-like costume in FIG. 1, the handle 36 of trick-or-treat receptacle 34 may be in the shape of a bone as illustrated in FIG. 3. Trick-or-treat receptacle 34 may be decorated with a skull.

Figure 4:
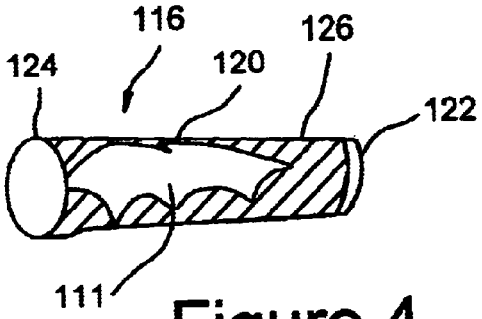
FIG. 4 is a side view of an alternative embodiment of the present invention.

As illustrated in the alternative embodiment of FIG. 4, a battery housing member 120 can also have decoration. Decorative member 118 is a translucent printed film over battery housing 120. Battery housing 120 contains elements commonly used in a flashlight, including a light bulb, a reflector to direct the output from the light bulb, an on/off switch, and batteries. In this embodiment, the outer surface 126 of decorative member 118 carries an illustration 111 of a bat-like wing. A flashlight 116 of this type is in accordance with the invention be sold with a costume representing a vampire, bat person, or other such characterization.

Figure 5:
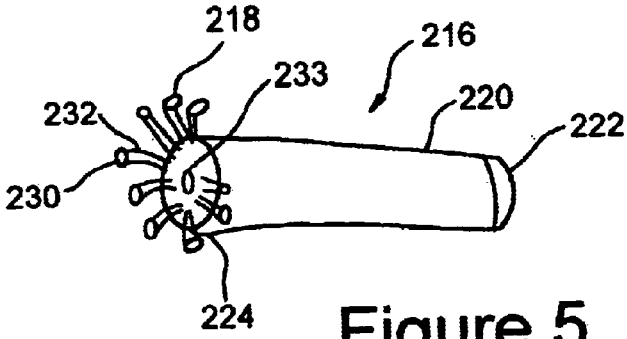
FIG. 5 is a front view of a trick-or-treat receptacle that is configured and dimensioned to be sold with the costume illustrated in FIG. 1 and the flashlight illustrated in FIG. 2.

FIG. 5 represents an alternative embodiment of flashlight 216 in which decorative member 218 is comprised of multiple light output members 230 connected by fiber optic like members 232 to a light source 233 contained within battery housing member 220. For example, decorative member 218 may contain multiple light output members 230 that represent eyeballs. Through a fiberoptic connection to the light source these light output members 230 will provide multiple source positions and directions of light output, each corresponding to an "eyeball" light output member 230.

Figure 6:
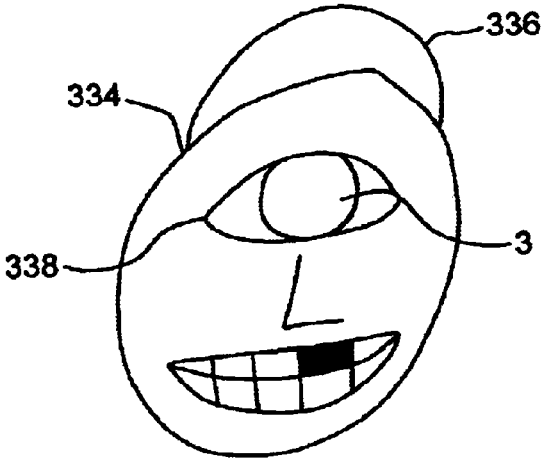
FIG. 6 is a front view of a trick-or-treat receptacle and flashlight combination that is configured and dimensioned to be sold with the costume illustrated in FIG. 1.

Referring to FIG. 6, an alternative embodiment of the present invention is illustrated. In this embodiment, the flashlight is an integral part of the trick-or-treat receptacle. More particularly, in accordance with this embodiment, a flashlight 338 takes the form of a skull with one eye. A lens 318 serves as the output of trick-or-treat receptacle flashlight 338 and visually appears as a large portion of eye 338. When the user carries trick-or-treat receptacle 338 by its handle 336 the user can easily direct the light in any direction he desires.

Figure 7:
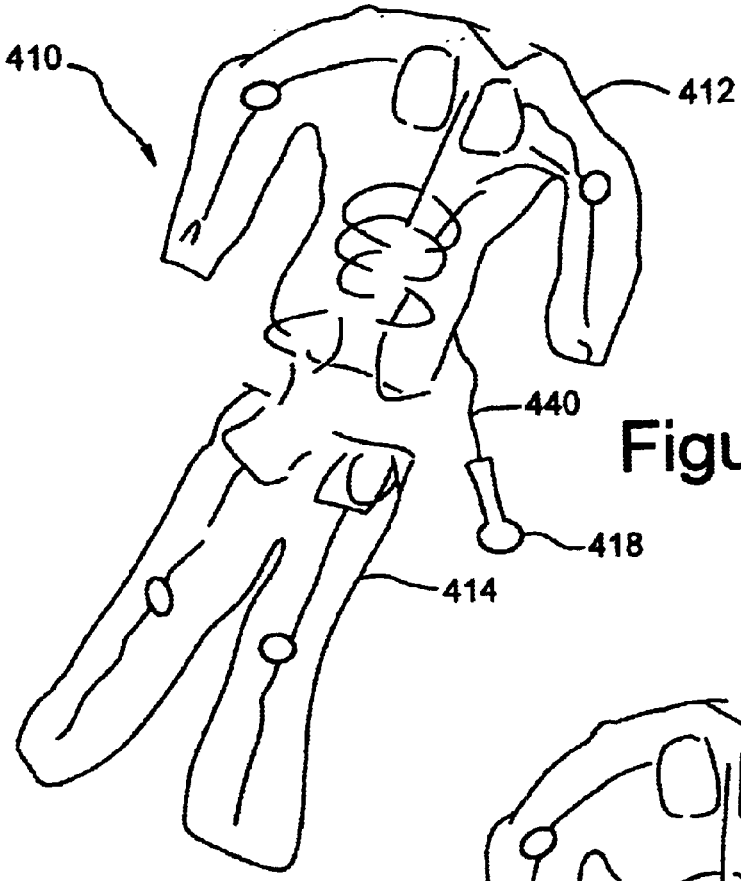
FIG. 7 is a perspective view of a costume commonly worn by children for Halloween with a flashlight such as one illustrated in FIG. 2 tethered to the costume.

FIG. 7 illustrates an alternative embodiment of costume 410 in which flashlight 418 is integrally connected to costume 410 by a tether 440. Such a configuration will make the chance of the child losing the flashlight de minimus.

Figure 8:
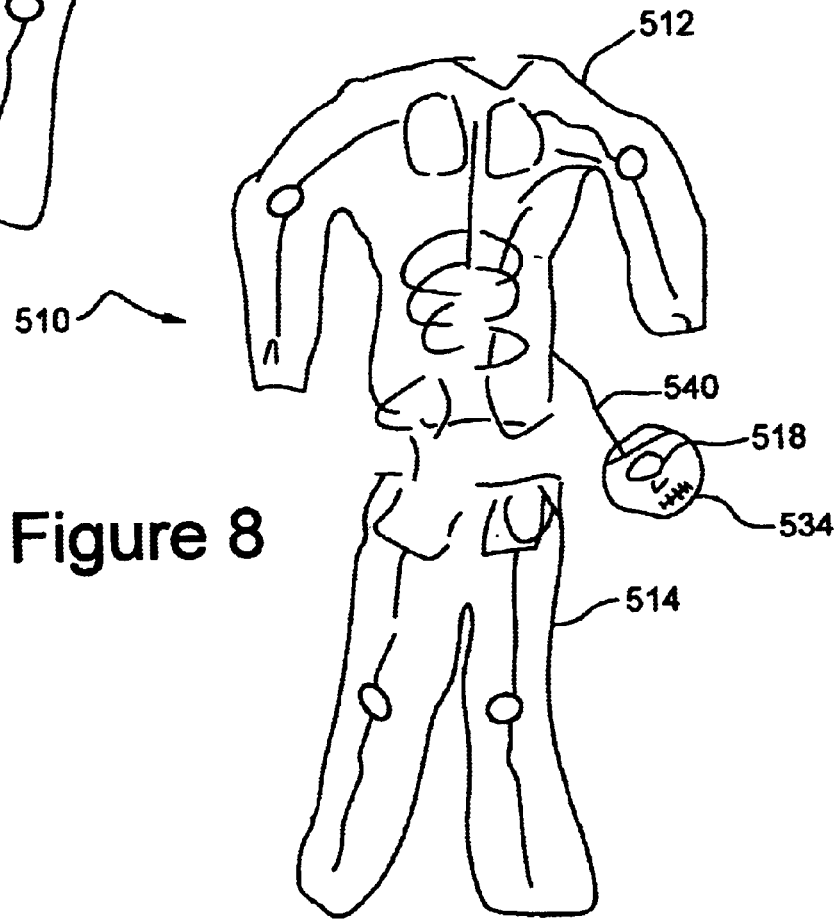
FIG. 8 is a prospective view of the costume commonly worn by children for Halloween with a trick-or-treat receptacle similar to the one illustrated in FIG. 6 tethered to the costume.

FIG. 8 illustrates an alternative embodiment of costume 510 in which trick-or-treat receptacle 534 is integrally connected to costume 510 by tether 540. In this embodiment, flashlight 518 is an integral part of trick-or-treat receptacle 534, as illustrated in FIG. 6.

By making the flashlight 16 correspond to the costume 10, making it part of the actual costume 10 itself, children will want to take a flashlight 16 with them. This will decrease battles of will between the children and their parents in making the child take a flashlight, and decrease the likelihood of the child losing a flashlight such as flashlight 16.

In the description, reference is made to the accompanying drawings, which form a part hereof, and which illustrate examples of the invention. Such examples, however, are not exhaustive of the various embodiments of the invention, and therefore, reference is made to the claims which follow the description for determining the scope of the invention. While illustrative embodiments of the invention have been described, it is, of course, understood that various modifications of the invention will be obvious to those of ordinary skill in the art. Such modifications are within the spirit and scope of the invention, which is limited and defined by the appended claims.

I claim:

1. A costume to be worn by a person, comprising:

(a) a flexible member having an appearance which creates, in the mind of an individual viewing said flexible member, an image of a person, animal, character or thing;

(b) attachment structure, secured to said flexible member and configured to be attached to a person by extending around a part of the body of the person while said costume is being worn by the person to attach said flexible member to the person and by forming a garment or garment-like member with said flexible member;

(c) a light emitting member having an appearance which creates, in the mind of an individual viewing said light emitting member, an associated image associated with said image of a person, animal, character or thing, wherein said light emitting member is tethered to said flexible member.

2. A costume to be worn by a person as in claim 1, wherein said garment-like member comprises:

(i) a shirt-like garment section; and (ii) a pants-like garment section.

3. A costume to be worn by a person as in claim 1, wherein said attachment structure is integral with and secured to said flexible member.

4. A costume to be worn by a person as in claim 3, wherein the combination of said attachment structure with said flexible member forms a conventional garment structure.

5. A costume to be worn by a person as in claim 1, wherein said light emitting member comprises a flashlight with a decorative member to create said appearance which creates, in the mind of an individual viewing said light emitting member, an associated image associated with said image of a person, animal, character or thing.

6. A costume to be worn by a person as in claim 5, wherein said decorative member which creates said appearance which creates, in the mind of an individual viewing said light emitting member, an associated image associated with said image of a person, animal, character or thing is formed as a part of said light emitting member which is seen to emit light.

7. A costume to be worn by a person as in claim 5, wherein said decorative member which creates said appearance which creates, in the mind of an individual viewing said light emitting member, an associated image associated with said image of a person, animal, character or thing is a decal applied to said light emitting member.

8. A costume to be worn by a person as in claim 1, wherein said light emitting member is tethered to said flexible member.

9. A costume to be worn by a person as in claim 1, wherein said light emitting member is powered by AAA-sized or smaller battery.

* * * * *